US005715878A

United States Patent [19]

Ondish

[11] Patent Number: 5,715,878

[45] Date of Patent: Feb. 10, 1998

[54] JIG FOR A MOLDER-PLANAR

[76] Inventor: Andrew Ondish, 94 Perrin Ave., Shavertown, Pa. 18708-1431

[21] Appl. No.: 798,381

[22] Filed: Feb. 10, 1997

[51] Int. Cl.[6] ..... B27C 5/02

[52] U.S. Cl. ..... 144/154; 144/135.2; 144/134.1; 144/137; 269/56; 269/58; 269/268; 409/219; 409/225

[58] Field of Search ..... 144/2.1, 134.1, 144/137, 135.2, 154, 371, 372; 269/55, 56, 58, 189, 246, 268, 303; 409/219, 221, 225, 226

[56] References Cited

U.S. PATENT DOCUMENTS

| | | | |
|---|---|---|---|
| 1,685,572 | 9/1928 | Onsrud | 144/154 |
| 1,921,715 | 8/1933 | Whitney et al. | 144/154 |
| 3,215,175 | 11/1965 | Hibner | 144/154 |
| 4,327,786 | 5/1982 | Markkula | 144/154 |
| 4,986,152 | 1/1991 | Sammons | 144/137 |

*Primary Examiner*—W. Donald Bray
*Attorney, Agent, or Firm*—Michael J. Delaney

[57] ABSTRACT

A jig for holding an arcuate wood piece is mounted on the table of a molder-planar. The jig has a base which is attached to the table. Mounted for rotation on the base is a clamp holder. A clamp is attached to the clamp holder for holding the arcuate wood piece for rotation with the clamp holder and for engagement with the cutting tool of the molder-planar so as to cut the arcuate wood piece.

2 Claims, 2 Drawing Sheets

JIG FOR A MOLDER-PLANAR

FIELD OF THE INVENTION

This invention relates to an improved jig for use with a conventional molder-planar in cutting an arcuate wood piece.

BACKGROUND OF THE INVENTION

It is known in the prior art to provide a jig for use in cutting an arcuate wood piece. However, the prior art devices are not entirely satisfactory for use by an artisan who processes a limited number of wood pieces at one time. Some of the jigs are extremely complex. Others are very expensive. Still others are designed for mass production of wood pieces and, as such, are both complex and expensive. The jig of this invention is designed for an artisan whose work requires an inexpensive way of making a limited number of arcuate wood pieces at one time.

SUMMARY OF THE INVENTION

It is an object of this invention to provide a simple and inexpensive jig for use with a conventional molder-planar to process arcuate wood pieces, such as a rail easing. A rail easing is a wood work piece in the shape of a hand rail and used to connect sections of hand rail which are not in line with each other, i.e., spaced vertically or horizontally.

It is another object of this invention to provide a jig which is readily attached to and removed from the table of a molder-planar.

It is still another object of this invention to provide a jig which can be used by an artisan who needs to make only a limited number of wood pieces at one time.

The above objects can be accomplished by providing a jig which includes a base which is secured to the table of a molder-planar. A circular clamp holder is mounted on the base for rotation thereon. A clamp is secured to the clamp holder. The clamp secures an arcuate wood work piece to the clamp and clamp holder. In use the drive rollers of the molder-planar contact the top of the wood work piece and rotate the work piece, clamp and clamp holder as a unit so that the wood work piece is forced into contact with the cutters of the molder-planar so as to cut the wood work piece.

DETAILED DESCRIPTION OF THE DRAWINGS

Figure 1:
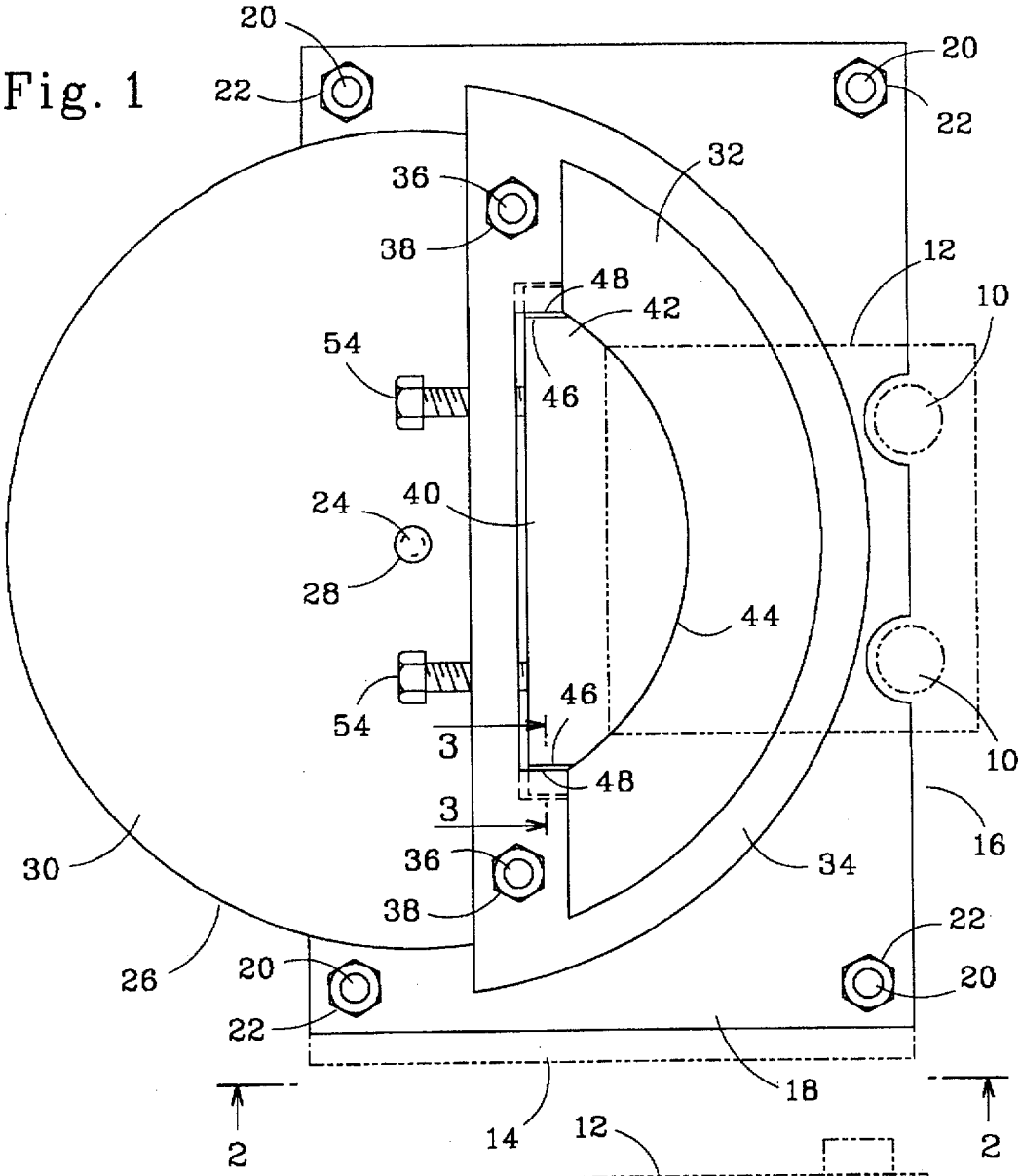
FIG. 1 is a plan view of the jig of this invention.
Figure 2:
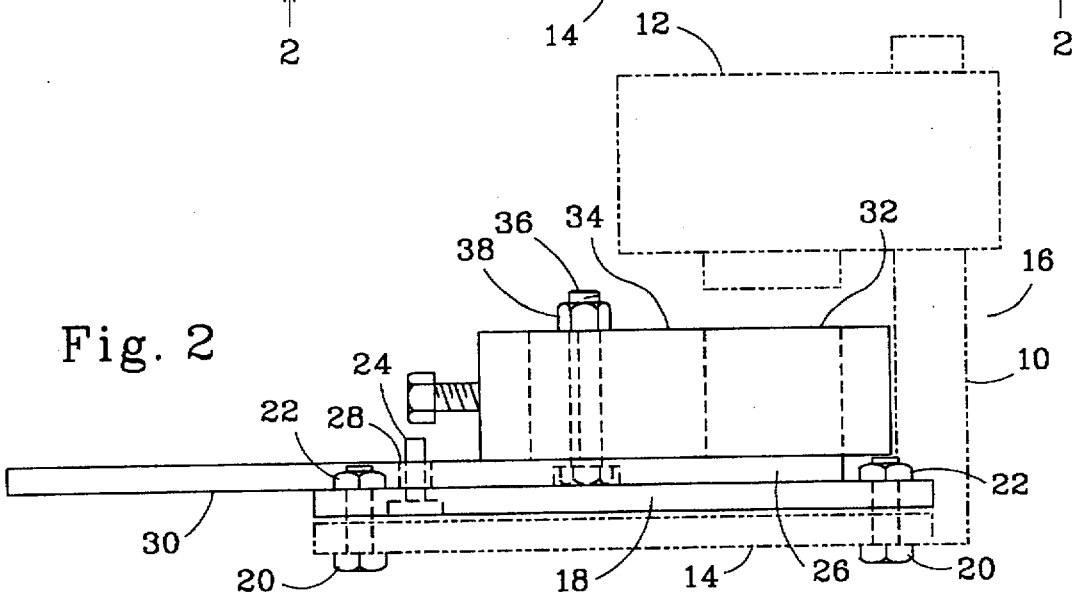
FIG. 2 is a view taken along the lines 2—2 of FIG. 1.

Referring to FIGS. 1 and 2, shown in phantom lines are the support rods 10, cutter and drive rollers head 12, and table 14 of a molder-planar, generally indicated as 16. The jig of this invention includes a base 18 which is secured to the table 14 of the molder-planar 16 by means of bolts 20 which pass through holes in table 14 and base 18. Nuts 22 are in threaded engagement with the threads of bolts 20 to secure the base 18 to the table 14. The base 18 has an upwardly extending pin 24 attached thereto. Mounted for rotation on the base 18 is a circular clamp holder 26 having a center hole 28 through which pin 24 extends. Thus, clamp holder 26 may rotate on base 18 about pin 24. As best shown in FIG. 2, clamp holder 26 has a portion 30 which extends horizontally beyond the base 18 and table 14 so as to allow the clamp holder 26 to be easily rotated by hand to aid in removing and inserting a work piece (not shown) in the arcuate recess 32, best seen in FIG. 1, of clamp 34. Clamp 34 is attached to clamp holder 26 by means of bolts 36 passing through a countersunk hole in clamp holder 26 and a hole in clamp 34. Nuts 38 are in threaded engagement with the threads of bolts 36 to hold clamp 34 and clamp holder 26 together. The clamp 34 is in the shape of a half moon with an arcuate recess 32 therein extending adjacent the outside edge of the clamp 34.

Figure 3:
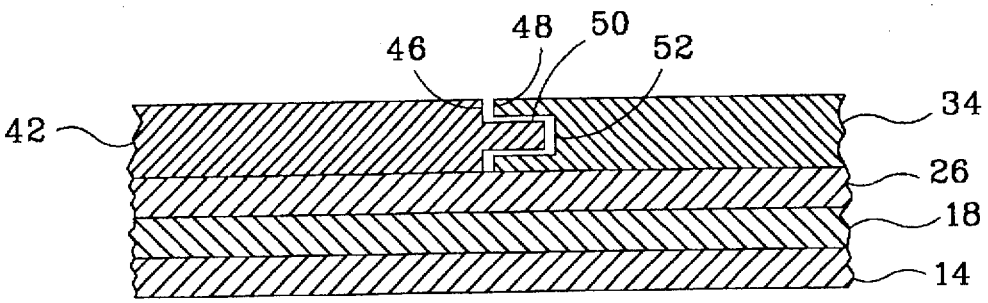
FIG. 3 is a view taken along the lines 3—3 of FIG. 1.

Referring to FIG. 1, the clamp 34 has a notch 40 therein to receive a movable jaw 42 which is slidable therein. The jaw 42 has an arcuate outer side 44 which forms one side of the arcuate recess 32. The jaw 42 has side surfaces 46 which mate with surfaces 48 of notch 40. As illustrated in FIG. 3, the side surfaces 46 of the jaw 42 have an integral key 50 thereon which fits in a keyway 52 which is formed in the side surfaces 48 in the clamp 34. Thus key 50 and keyway 52 allow the jaw 42 to slide relative to the notch 40 and move outwardly in response to rotation of clamp bolts 54 to allow side 44 of jaw 42 to engage a wood piece (not shown) which is placed within the arcuate recess 32. The threads of clamp bolts 54 are in threaded engagement with threaded holes in clamp 34 and the ends of clamp bolts 54 are in contact with jaw 42.

Figure 4:
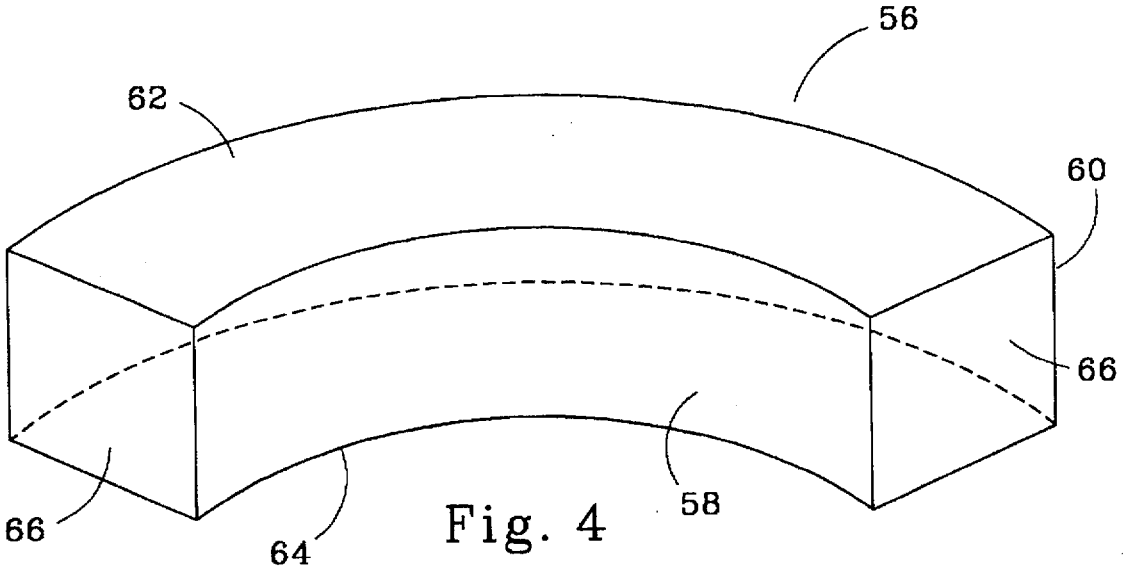
FIG. 4 is an arcuate wood work piece prior to being cut by the cutters of a molder-planar.

FIG. 4 shows an arcuate wood work piece 56 prior to being cut by the cutters of the molder-planar 16. The wood work piece 56 has a first vertically extending side 58 and a second vertically extending side 60. The sides 58 and 60 extend parallel to each other. The wood work piece 56 has a top surface 62 and a bottom surface 64 which extend parallel to each other. The wood work piece has end surfaces 66. Thus a cross section of the wood work piece has the shape of a rectangle.

Figure 5:
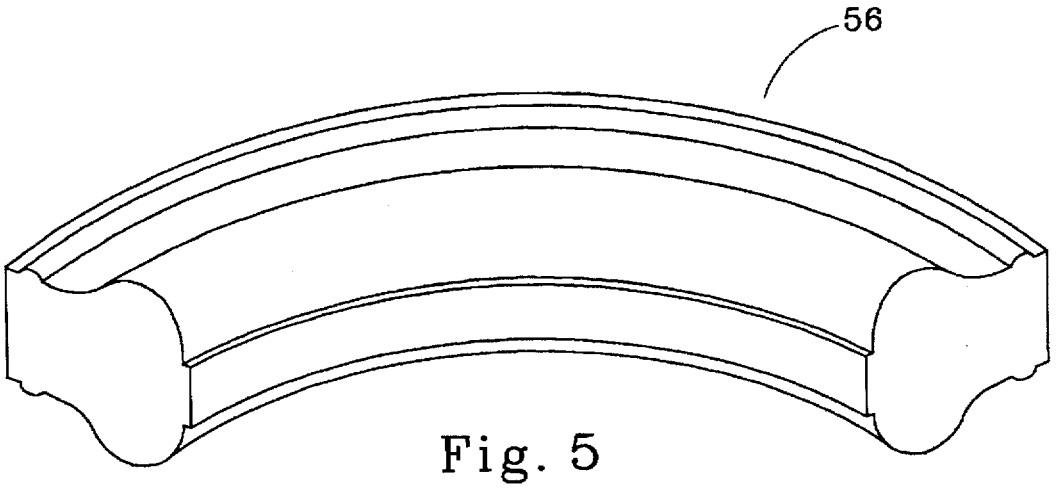
FIG. 5 is an arcuate wood piece, i.e. a rail easing, after being cut by the cutters of a molder-planar.

FIG. 5 shows a wood work piece 56 after it has been cut by the cutters of the molder-planar 16. The wood work piece shown is a rail easing. The rail easing has the same configuration as the hand rail (not shown) to which it will be attached. While FIG. 5 shows a specific configuration for a rail easing it should be understood that other configurations could be cut by the cutters of the molder-planar 16 while using the jig of this invention.

In use, with the clamp holder 26 manually rotated by grasping portion 30 of clamp holder 26 so that the clamp 34 extends over the base 18. A wood work piece 56 is placed in the arcuate recess 32 of the clamp 34 and the side surface 44 of jaw 42 forced into contact with side 58 of the work piece 56 by rotation of clamp bolts 54 to secure the work piece 56 to clamp 34. The clamp holder 26 is rotated so that the wood work piece 56 is under the cutter and drive rollers head 12 of the molder-planar 16. The drive rollers contact the top 62 of the wood work piece 56 and cause the clamp holder 26 and clamp 34 to rotate and the cutters of the molder-planar 16 to cut the wood work piece 56. After such cutting the clamp holder 26 is then manually rotated so that the clamp 34 again extends over the base 18. The side surface 44 of jaw 42 is then moved out of contact with side surface 58 of the wood work piece 56 by loosening clamp bolts 54. The wood work piece 56 is removed from the arcuate recess 32 and the top of the work piece 56 is placed at the bottom of the arcuate recess 32. The side 44 of jaw 42 is then forced into contact with the work piece 56 by tightening clamp bolts 54 to secure the work piece 56 to the clamp 34. The clamp holder 26 is again manually rotated so that the drive rollers contact the top of work piece 56 and cause the clamp holder 26 and clamp 34 to rotate and the wood work piece 56 to be cut by the cutters of the molder-planar 16. The clamp holder 26 is again manually rotated so that clamp 34 extends over base 18. Wood work piece 56 is then removed from the clamp 34 by loosening clamp bolts 54. Wood work piece 56 is at that time in the shape shown in FIG. 5.

Although I have described my invention hereinabove in considerable detail, I do not wish to be limited narrowly to the exact and specific particulars disclosed, but I may also use such substitutes, modifications and equivalents as are included within the scope and spirit of my invention or pointed out in the appended claims.

I claim:

1. A jig for holding an arcuate wood piece for rotation and engagement with cutters of a molder-planar comprising;

(a) a base for attachment to the table of a molder-planar, (b) a clamp holder mounted for rotation on said base, (c) a clamp attached to said clamp holder for holding said arcuate wood piece, and (d) said clamp has an arcuate recess for receiving said arcuate wood piece and a slidable jaw for contacting a side of said arcuate wood piece and securing said arcuate wood piece in said arcuate recess.

2. The jig of claim 1 wherein said clamp holder extends horizontally beyound the edge of said base and said table.

* * * * *